US010196110B1

(12) United States Patent
Norton

(10) Patent No.: US 10,196,110 B1
(45) Date of Patent: Feb. 5, 2019

(54) ADJUSTABLE POSITIVE RESTRAINT DOCKING OR MOORING SYSTEM

(71) Applicant: Daniel Norton, Apex, NC (US)

(72) Inventor: Daniel Norton, Apex, NC (US)

(73) Assignee: Daniel Norton, Apex, NC (US)

( * ) Notice: Subject to any disclaimer, the term of this patent is extended or adjusted under 35 U.S.C. 154(b) by 0 days.

(21) Appl. No.: 15/830,602

(22) Filed: Dec. 4, 2017

(51) Int. Cl.
*B63B 21/00* (2006.01)

(52) U.S. Cl.
CPC ..... *B63B 21/00* (2013.01); *B63B 2021/001* (2013.01)

(58) Field of Classification Search
CPC ..... B63B 21/21; B63B 2021/001
See application file for complete search history.

(56) References Cited

U.S. PATENT DOCUMENTS

2002/0148055 A1* 10/2002 Alexander ..... B65G 69/2841 14/71.1
2018/0079090 A1* 3/2018 Koenig ..... A61B 34/30

* cited by examiner

*Primary Examiner* — S. Joseph Morano
*Assistant Examiner* — Jovon E Hayes
(74) *Attorney, Agent, or Firm* — Ascentage Patent Law, LLC; Travis Lee Johnson; David S. Einfeldt

(57) ABSTRACT

Contemplated herein is an adjustable positive restraint docking system, the system having a latching assembly, the latching assembly being configured to be affixed to a docking point on a dock so as to act as a mooring point for a watercraft to said docking point. The latching assembly can also include a latching head assembly, the latching head assembly wherein in the embodiments shown the latching head assembly can also be provided with a receiving channel having an open portion being configured to receive a secondary locking component provided about the watercraft. A linkage assembly can be provided which within or about the channel, which can selectively block or open the open portion of the receiving channel. In some embodiments, the linkage assembly can be configured to pass through a toggle point between an open state and a locked state.

20 Claims, 21 Drawing Sheets

SECTION A-A

SECTION A-A

SECTION A-A

SECTION A-A

ADJUSTABLE POSITIVE RESTRAINT DOCKING OR MOORING SYSTEM

COPYRIGHT STATEMENT

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

BACKGROUND

1. Field of the Invention

The present invention relates to docking and mooring of watercraft, particularly along docks, peers, slips, etc.

2. Description of the Prior Art

Docking or Mooring of vehicles, and particularly watercraft, has historically required attaching of the watercraft to anchor points provided along a dock using a rope or chain. Some more recent systems have utilized various attachment methods, including suction cups or other attachment means.

Some of the common problems encountered in watercraft mooring or docking include rising and lowering of the tide with respect to the dock, waves, wakes of other craft, wind, or other environmental factors which may cause relative motion between the dock and the particular watercraft attached thereto. This relative motion can often damage the watercraft or the dock itself. Additionally, ease of use, and attachment reliability are the focus of constant improvement.

I would like to mention that there is also potential to use this automated docking system for unmanned watercraft, commonly called USV (unmanned surface vehicles), UUVs (unmanned underwater vehicles), ROVs (remotely operated vehicles), etc. Many of the same features outlined in this application will be useful as a docking system underneath the water surface, as well as on the surface.

BRIEF DESCRIPTION OF THE INVENTION

Mooring or docking watercraft to docks in a reliable and easy manner which allows for relative shifting between the dock and the watercraft without damaging either is a continuing endeavor. As such, the present invention seeks to provide improvements which allow easy connections and reliable retention to the dock in a manner which allows relative movement and absorbs environmental motion while protecting the watercraft as well as the dock station. In order to achieve these goals, the present invention includes an adjustable positive restraint docking system, the system having a latching assembly, the latching assembly being configured to be affixed to a docking point on a dock so as to act as a mooring point for a watercraft to said docking point.

The latching assembly can also include a latching head assembly, the latching head assembly wherein in the embodiments shown the latching head assembly can also be provided with a receiving channel having an open portion being configured to receive a secondary locking component provided about the watercraft. A linkage assembly can be provided within or about the channel, which is configured to selectively block or open the open portion of the receiving channel. In some embodiments, the linkage assembly can be configured to pass through a toggle point between an open state and a locked state.

In some embodiments, one or more rollers can be provided within the receiving channel, wherein the one or more rollers can be configured to allow an axial rotation of the secondary locking component within the channel in the blocked/locked configuration.

As illustrated in the embodiments shown herein, one or more dampers can also be provided about one or more anterior sides of the latching head assembly, wherein at least one of the one or more dampers can be configured to allow pivoting of the latching head in a horizontal plane, or alternatively the dampers can allow for a dampened pitching motion in a vertical direction.

The latching assembly can also be provided with one or more guide portions which can be arranged so as to guide an approaching secondary locking component into alignment with the receiving channel from a plurality of approach angles or heights.

In some embodiments, the adjustable positive restraint docking system can be provided with an extension assembly provided between the latch assembly and the dock, in such embodiments the extension assembly can be configured to provide the latch assembly in an extended state or a stowed state from an edge of the dock. In some such embodiments the extension assembly can be provided having a 4-bar linkage.

In some embodiments, the adjustable positive restraint docking system can be provided with a plurality of rollers about a rear portion of the receiving channel.

In some embodiments, the adjustable positive restraint docking system can be provided with an additional roller provided on the linkage assembly wherein the roller is displaced by the linkage so as to block the open portion of the receiving channel in the locked state.

In some embodiments, the secondary locking component can be provided as a bar extending from the watercraft so as to extend into the receiving channel of the latch head assembly.

In some embodiments, the adjustable positive restraint docking system can be provided with a presence sensor located within the receiving channel of the latch head assembly, the presence sensor being configured to detect the presence of a secondary locking component within the receiving channel.

In some embodiments, the adjustable positive restraint docking system can be provided with a first linkage sensor located about the linkage assembly, the first linkage sensor being configured to detect when the linkage assembly is in the locked state.

In some embodiments, the adjustable positive restraint docking system can be provided with a second linkage sensor located about the linkage assembly, the second linkage sensor being configured to detect when the linkage assembly is in the open state.

In some embodiments, and as shown, the receiving channel of the latching head can be configured to receive a horizontally oriented secondary locking component.

It will be appreciated that in some alternative embodiments, the latching head can also be rotated 90 degrees in such a manner that the receiving channel is configured to receive a vertically oriented secondary locking component.

In some embodiments, the one or more dampers can be provided as a plurality of dampers being provided about opposing anterior sides of the latching head assembly.

In some embodiments, the adjustable positive restraint docking system can be provided with a vertical damper, the vertical damper being connected to the latching head along a vertical axis, the vertical damper being configured to allow the latching head assembly to translate vertically.

In some embodiments, the guide portions can be provided as angled plates having opposing ramps configured to guide the secondary locking component toward a central portion containing the receiving channel, the opposing ramps extending outwardly from the open portion of the guide channel, the opposing ramps also being angled away from a plane defined by the center and width of the guide channel.

It will also be appreciated by those having skill in the art that the embodiments shown illustrate the latching assembly as being provided about a dock, while the secondary latching component can be provided about the watercraft, however, these relative positions can also be reversed wherein the latching components are instead provided about the watercraft and the secondary latching components can instead be provided about the dock.

Various methods of use, as will be appreciated by those having skill in the art are also contemplated herein. In particular, there is also potential to use this automated docking system for unmanned watercraft, commonly called USV (unmanned surface vehicles), UUVs (unmanned underwater vehicles), ROVs (remotely operated vehicles), etc. Many of the same features outlined in this application can also be utilized as a docking system underneath the water surface, as well as on the surface as illustrated herein.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION

As discussed briefly above, the present invention seeks to provide improvements with regard to mooring or docking watercraft to docks in a reliable and easy manner which allows for relative shifting between the dock and the watercraft without damaging either is a continuing endeavor. As such, the present invention seeks to provide improvements which allow easy connections and reliable retention to the dock in a manner which allows relative movement and absorbs environmental motion while protecting the watercraft as well as the dock station.

FIGS. 1A-C and 2A-C respectively illustrate a watercraft 50 approaching and secured or moored to a dock 2, the dock being provided with an adjustable positive restraint docking system 10 in accordance with various aspects of the present invention. As illustrated the watercraft 50 can be provided with a secondary locking component 30 being configured to be received by or locked to by the adjustable positive restraint docking system 10. Further, as illustrated here, the adjustable positive restraint docking system 10 can be configured to extend from an edge portion of the dock 2, and in some embodiments, as will be discussed in more detail below, the adjustable positive restraint docking system 10 can also be retracted from the edge of the dock 2.

Figure 1A:
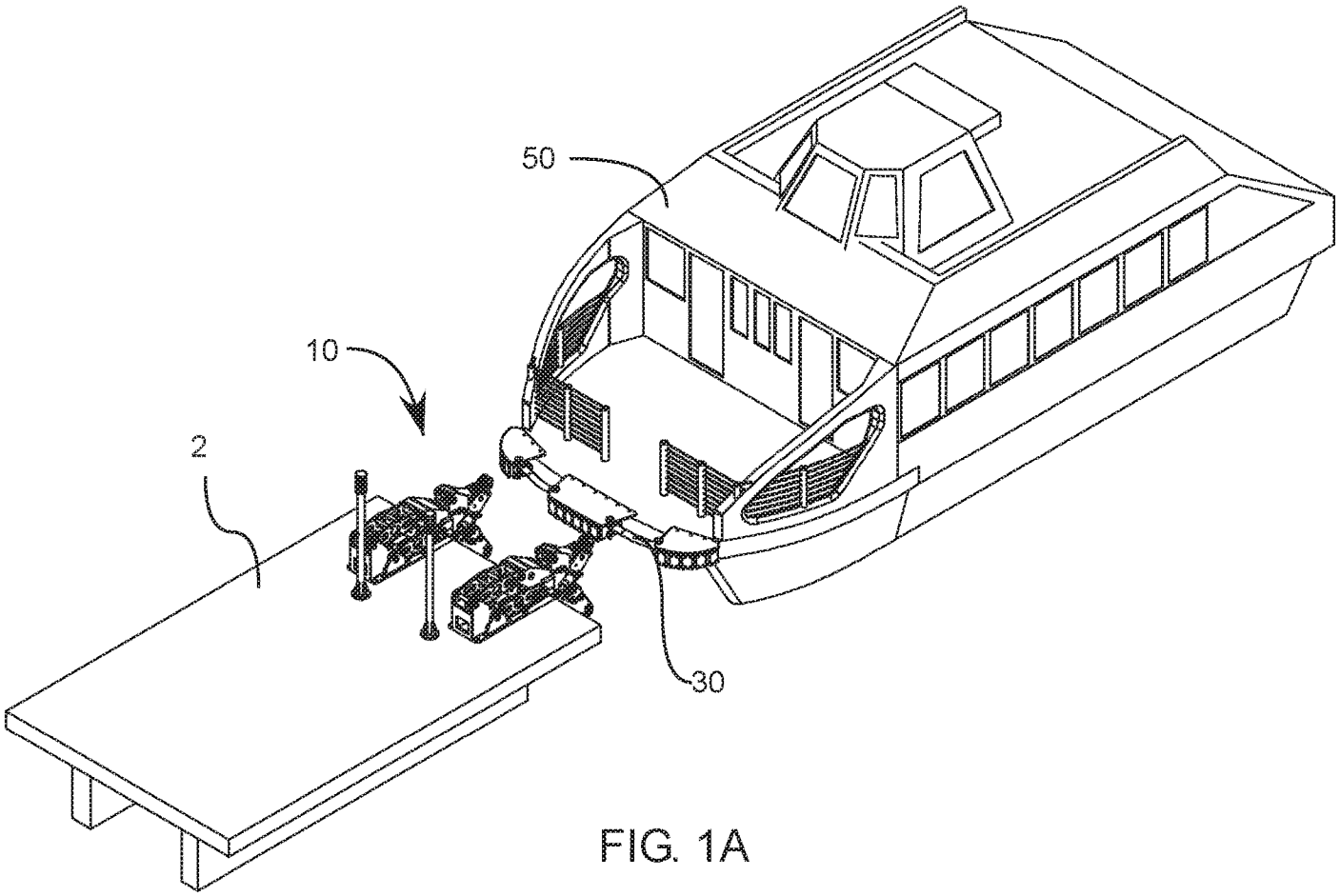
FIGS. 1A-C illustrate perspective top and side views of a watercraft approaching an adjustable positive restraint docking or mooring system in accordance with various aspects of the present invention.
Figure 1B:
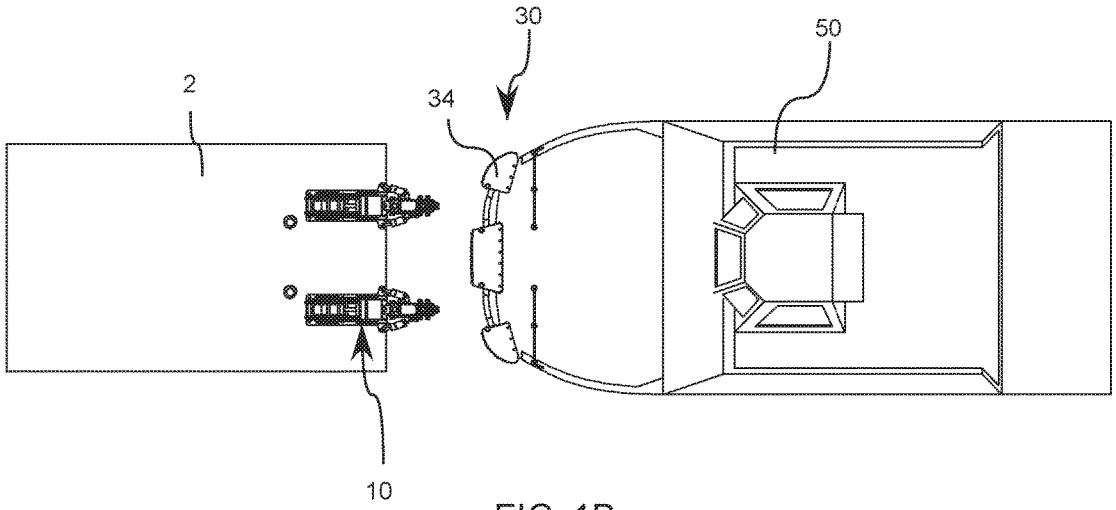
Figure 1C:
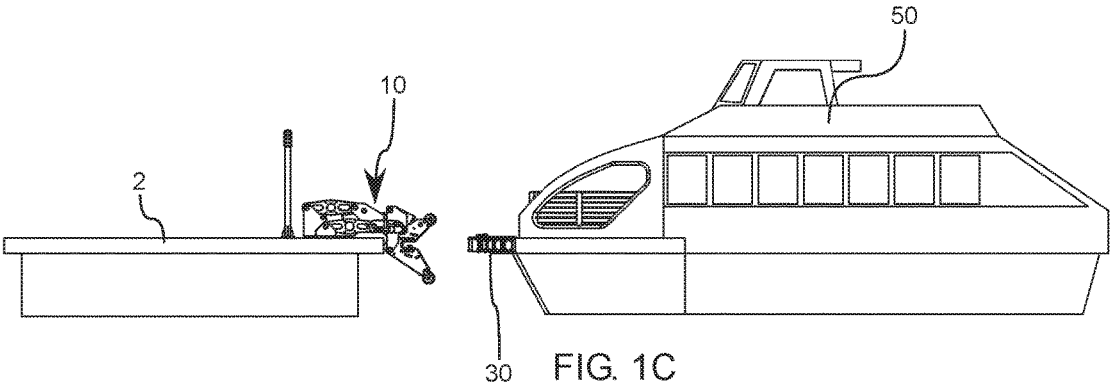
Figure 2A:
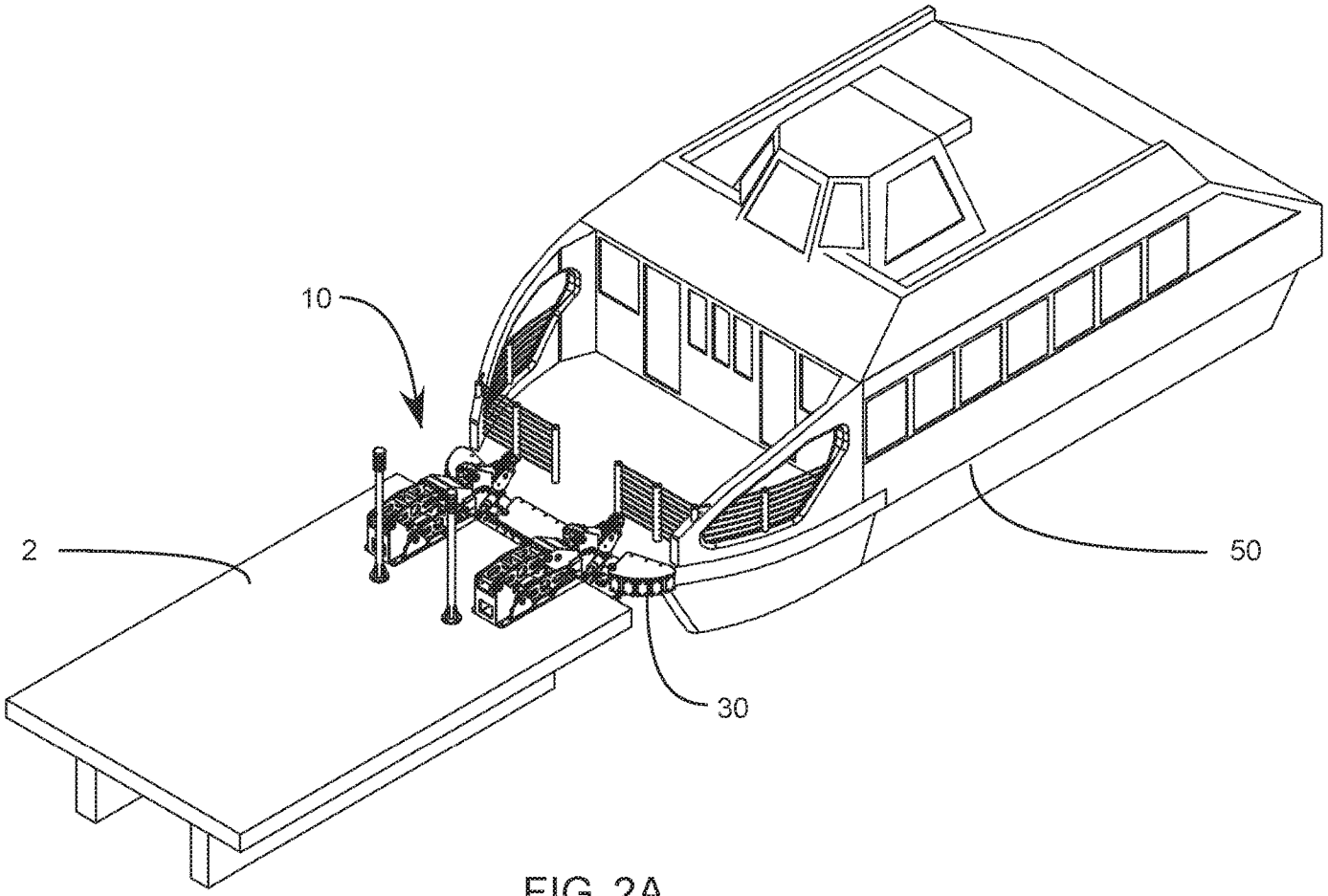
FIGS. 2A-C illustrate perspective top and side views of a watercraft docked at the adjustable positive restraint docking or mooring system of FIG. 1.
Figure 2B:
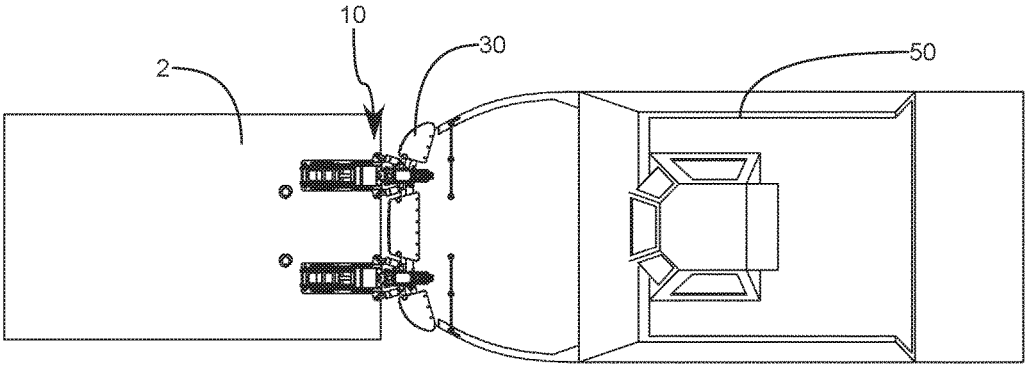
Figure 2C:
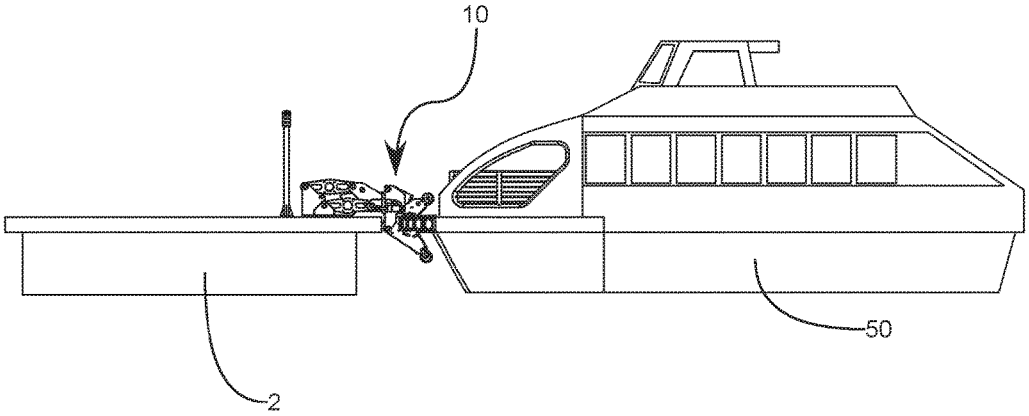
Figure 3A:
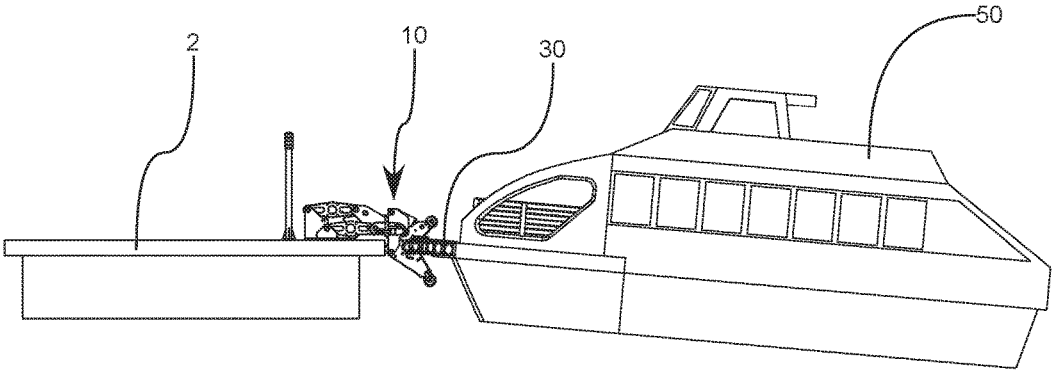
FIGS. 3A-B illustrate side views of a watercraft docked at the adjustable positive restraint docking or mooring system of FIG. 1 in various pitched positions.
Figure 3B:
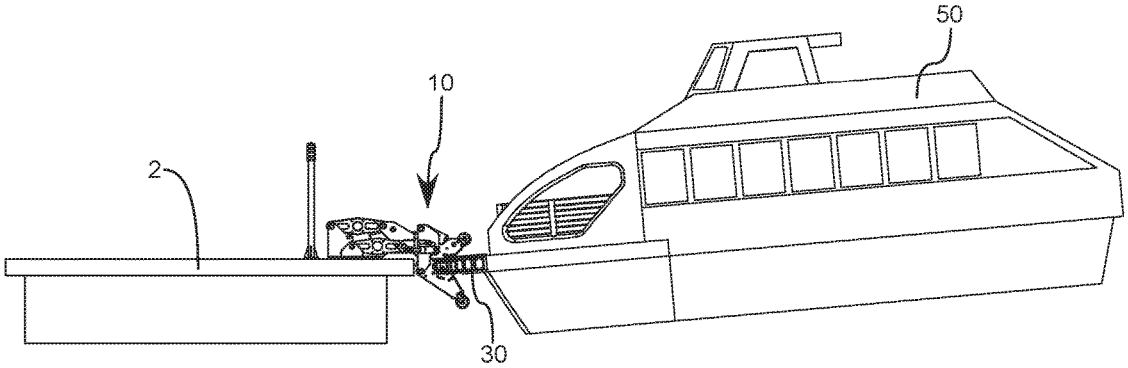

FIGS. 3A-B illustrate the watercraft 50 being secured to the adjustable positive restraint docking system 10 and various degrees of freedom of relative motion enabled by the adjustable positive restraint docking system 10. In particular the secondary locking component 30 is provided as a substantially horizontal and cylindrical bar which can rotate within corresponding receiving channels provided within the adjustable positive restraint docking system 10. This configuration allows the watercraft 50 to pitch up or down, as illustrated, in response to waves or changing tides while remaining securely moored to the adjustable positive restraint docking system 10. It will be appreciated that FIG. 3A illustrates an upward 5-degree pitch, while FIG. 3B illustrates a downward 5-degree pitch, which figures are merely illustrative and do not represent the maximum pitch angles.

Figure 4A:
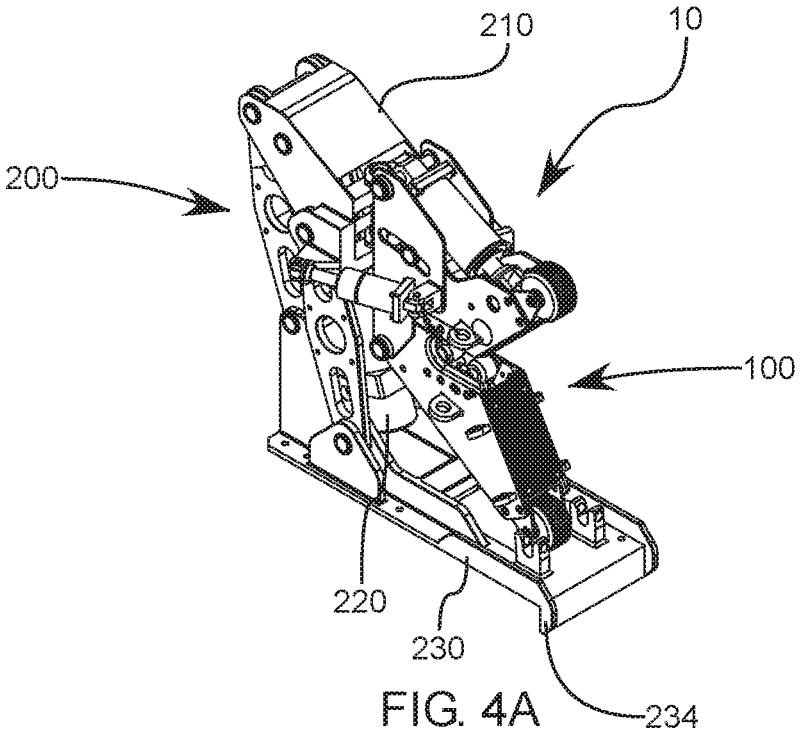
FIGS. 4A-B illustrate perspective and side views of the adjustable positive restraint docking or mooring system of FIG. 1 in a stowed state.
Figure 4B:
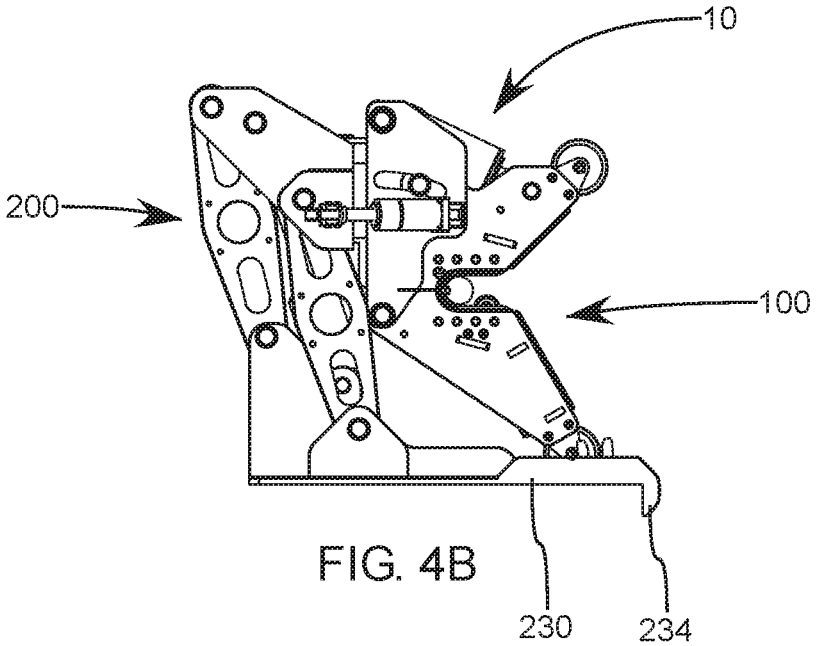
Figure 5A:
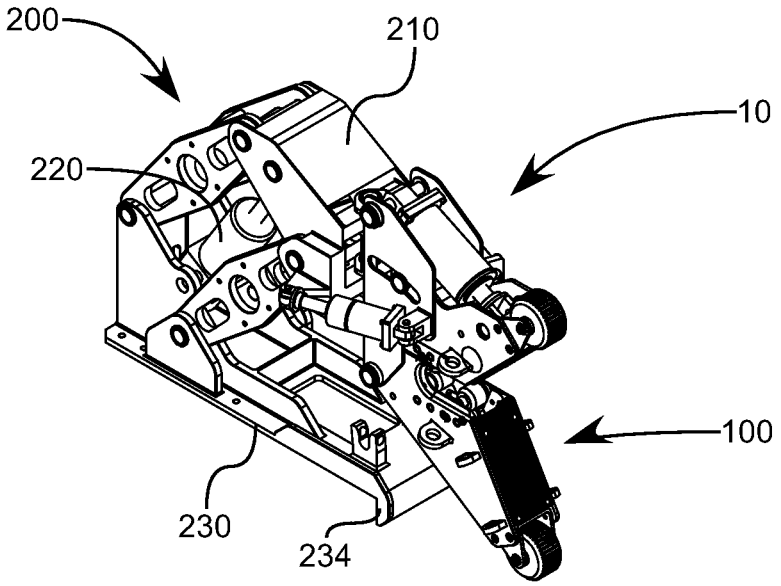
FIGS. 5A-B illustrate perspective and side views of the adjustable positive restraint docking or mooring system of FIG. 1 in a partially extended state.
Figure 5B:
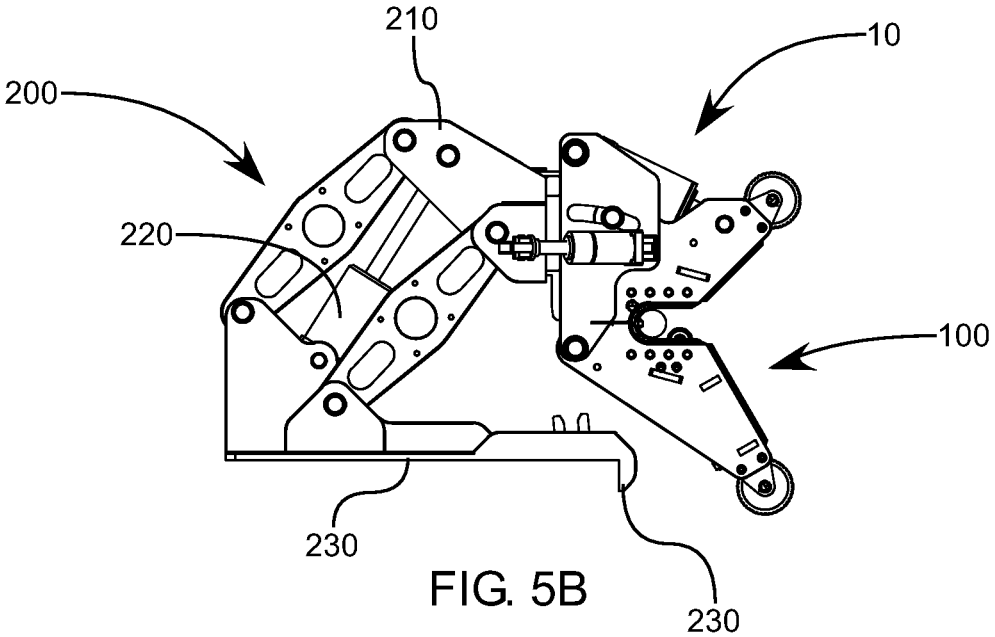
Figure 6A:
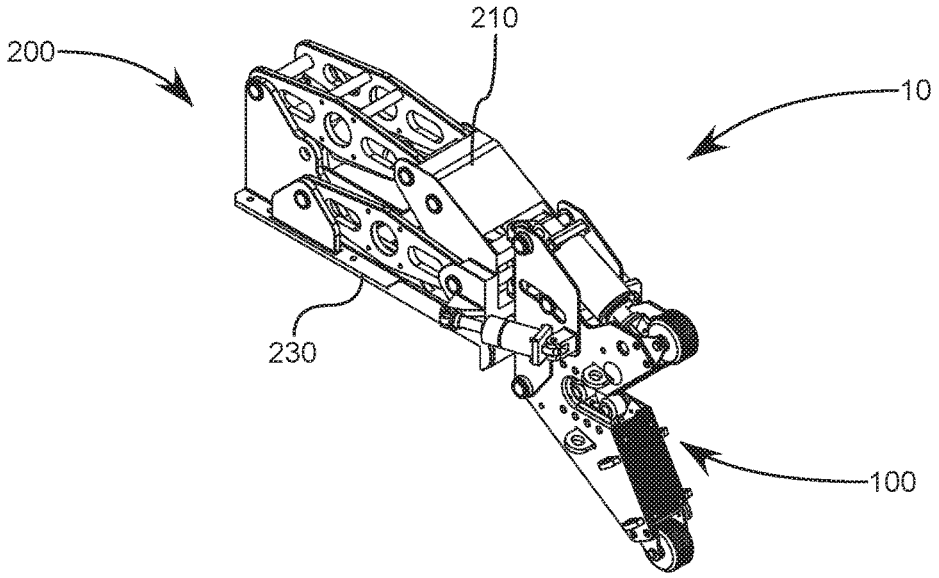
FIGS. 6A-B illustrate perspective and side views of the adjustable positive restraint docking or mooring system of FIG. 1 in an extended state.
Figure 6B:
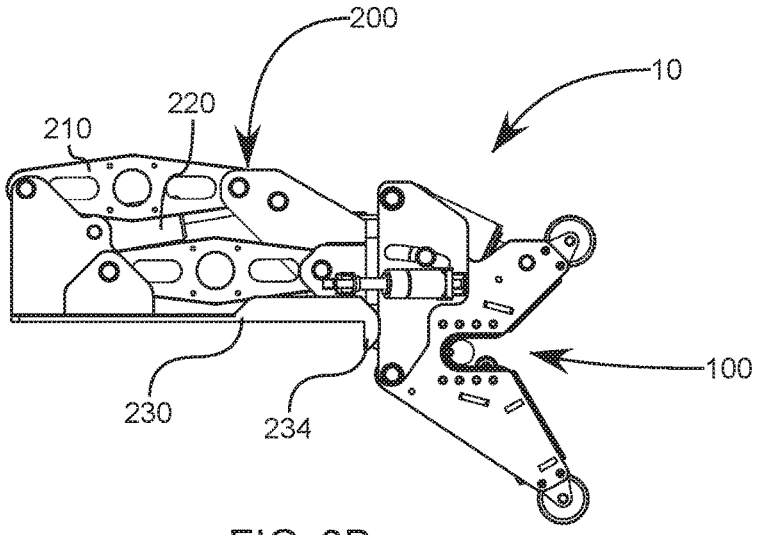

As discussed above, and as shown in FIGS. 4-6, the adjustable positive restraint docking system 10 can include an extension system 200 which can be configured to allow for extension of a latching assembly 100 out into an extended state as shown in FIGS. 6A-B, or be retracted into a stowed state, as illustrated if FIGS. 4A-B. As such FIGS. 4A-B, to FIGS. 5A-B, and FIGS. 6A-B respectively illustrate a progression from the stowed position, through an intermediate state, and to the extended state. This extension can be achieved by providing an extension system 200 having a 4-bar linkage 210 with an actuation mechanism 220, illustrated here as a hydraulic cylinder. It will be appreciated that any actuation devices discussed herein are illustrated as hydraulic actuation mechanisms, but can be provided using any number of alternative means such as worm gears, pneumatic cylinders, using any number of mechanical, electrical, or fluidic actuation means. Such means can include, for purposes of illustration, a forklift with a strap attachment could provide the actuation method, or a few people manually lifting the arm up and out of the way. It will then be appreciated that in scaled down versions, a manual method such as an extended rod to act as a lever with mechanical advantage to extend and actuate the devices might be preferred as a cost savings measure.

Additionally, the extension system 200 can be provided with a mounting plate 230 which can attach to the edge of the dock 2. The mounting plate 230 can include a lip portion 234 which extends over the edge of the dock so as to provide increased strength, stability, and ease of installation about the edge of the dock. Further the mounting plate 230 can be provided with a roller channel 238 on its upper surface so as to receive a roller provided on the latching assembly when moving into the stowed state.

It will also be understood that the extension system is illustrated as a 4-bar linkage, but can also be provided as a rocker, a singular hydraulic cylinder, provided on a horizontal swinging bar, none of which are shown, but could readily be adapted for use by one having skill in the art. A linearly actuated, or horizontal swing actuated system is also contemplated herein. In some such embodiments, a multi-degree of freedom actuating arm, like a robot arms commonly utilized in industrial applications, can also be used as the method to properly position the latching assembly in the active or extended state.

Figure 7A:
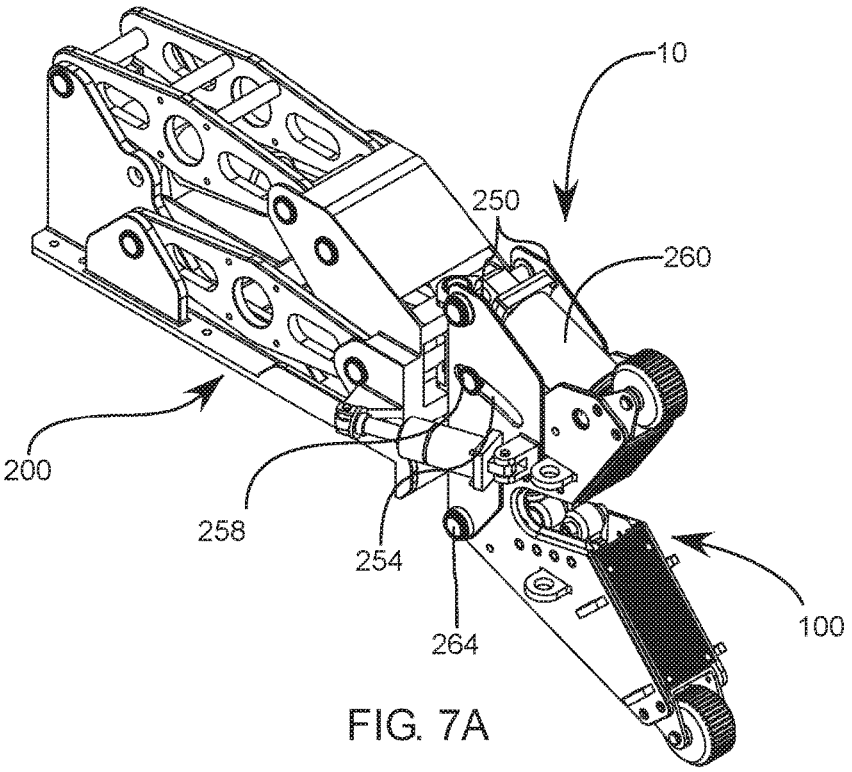
FIGS. 7A-B illustrate perspective and side views of the adjustable positive restraint docking or mooring system of FIG. 1 in an upwardly pitched state.
Figure 7B:
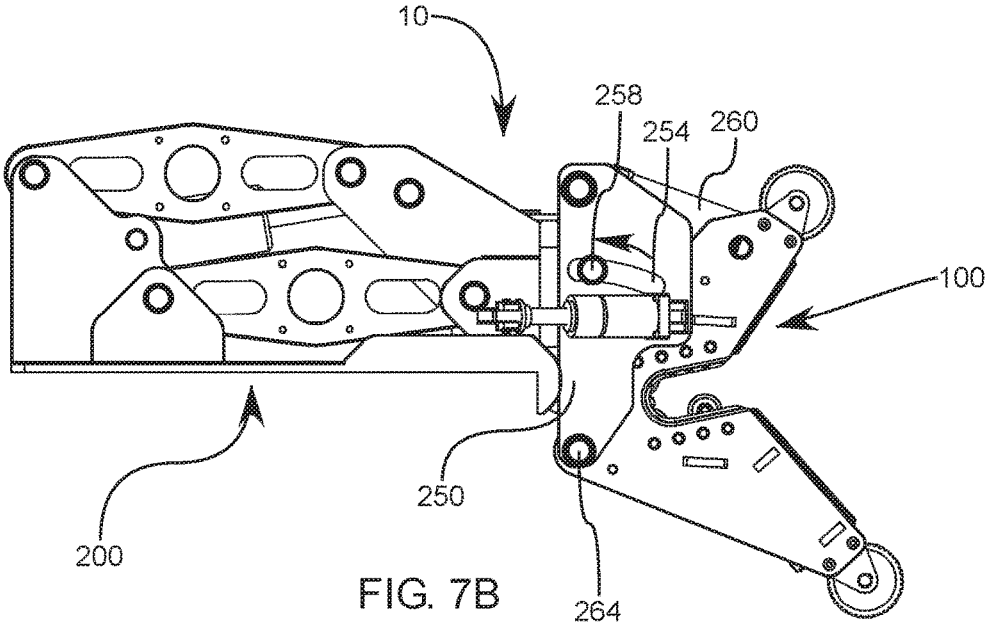
Figure 8A:
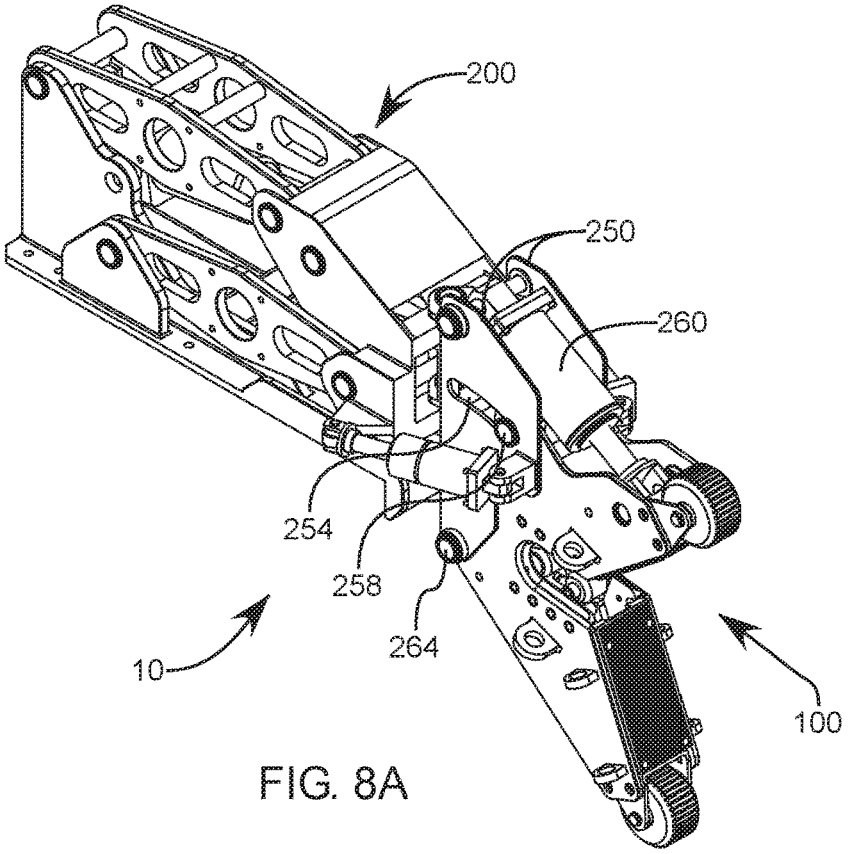
FIGS. 8A-B illustrate perspective and side views of the adjustable positive restraint docking or mooring system of FIG. 1 in a downwardly pitched state.
Figure 8B:
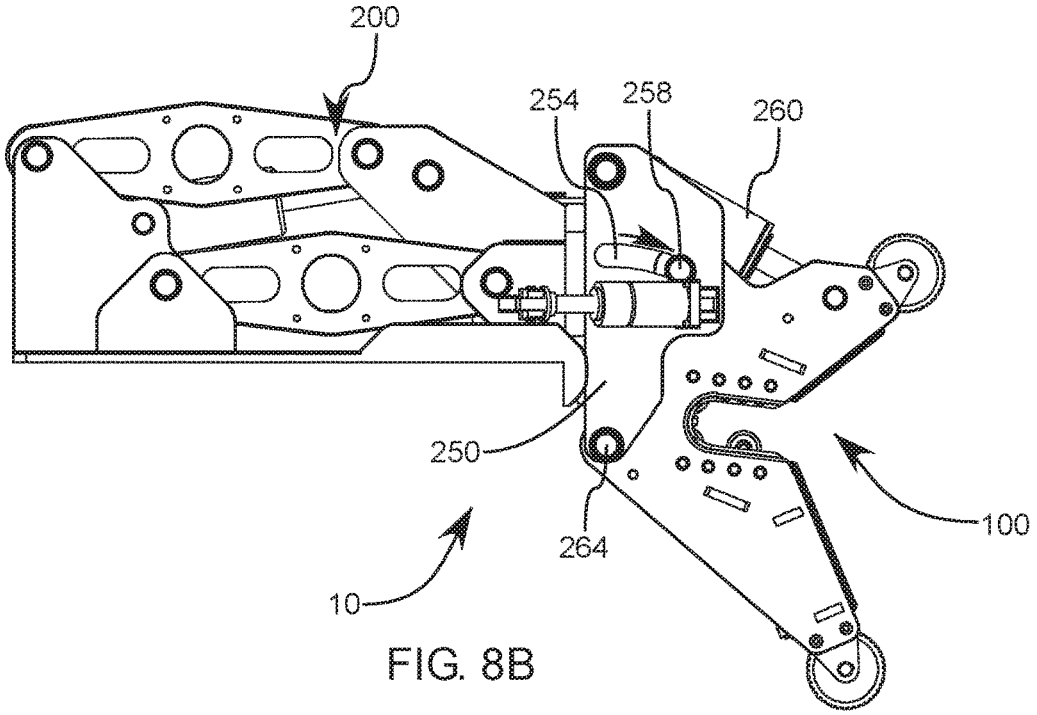

FIGS. 7-8 illustrate one of many relative degrees of motion which can be provided between the latching assembly 100 and extension assembly 200. As shown, FIGS. 7A-B illustrate an upwardly pitched position and FIGS. 8A-B illustrate a downwardly pitched position. In the embodiments shown, in order to allow for this relative pitching of the latching assembly 100, opposing pitch plates 250 can be provided with the latching assembly 100 provided therebetween. The latching assembly can be affixed to the pitch plates 250 by utilizing a hinge pin 264 and a first damper 260 which dampens a vertical pitching or rotational motion of the latching assembly 100 about the hinge pin 264. In some embodiments, the opposing pitch plates 250 can be provided with radial channels 254, wherein the latch assembly can be provided with an associated travel limiting protrusion 258 which extend into the radial channels 254 and thus limit the degree of motion allowed between the pitch plates 250 and the latch assembly 100 to the length of the radial channels with respect to the hinge pin 264. It will then be understood that the damper 260 is shown in a compressed state in FIGS. 7A-B and in an extended state in FIGS. 8A-B. In an alternative embodiment the damper 260 can be provided about a bottom portion and compressed in the downwardly pitched position and extended in the upwardly pitched position.

It will be further understood, that while the dampers illustrated here and discussed herein are merely utilized for exemplary purposes, as such, these dampers can be provided as simple spring elements, or alternatively replaced with more sophisticated systems such as servo controlled actuators with force feedback. Additionally, the dampening means illustrated herein is not mandatory for every application or embodiment, and in some instances the latch can be rigidly connected to the dock having no dampening.

Figure 9A:
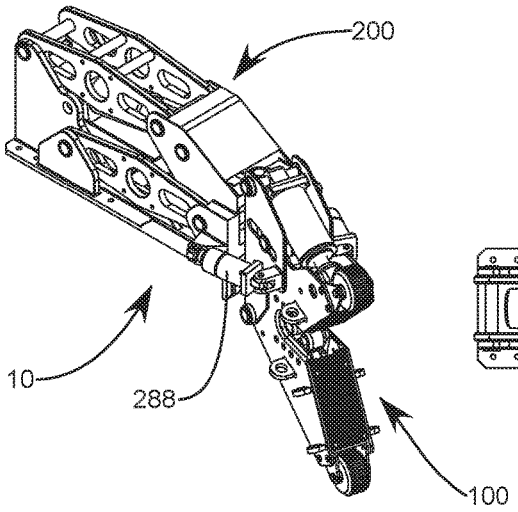
FIGS. 9A-B illustrate perspective and top views of the adjustable positive restraint docking or mooring system of FIG. 1 in a right laterally flexed state.
Figure 9B:
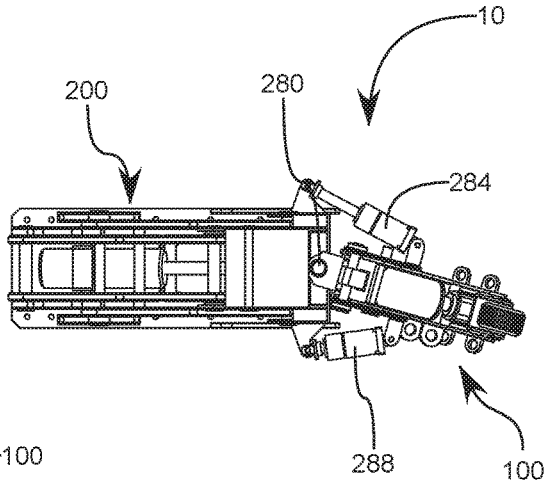
Figure 10A:
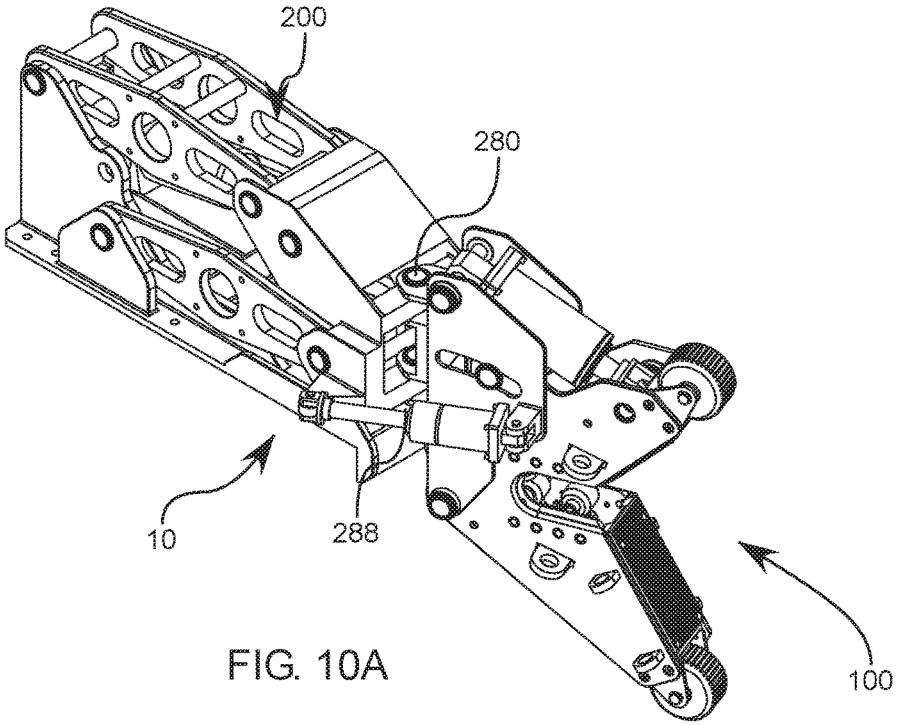
FIGS. 10A-B illustrate perspective and top views of the adjustable positive restraint docking or mooring system of FIG. 1 in a left laterally flexed state.
Figure 10B:
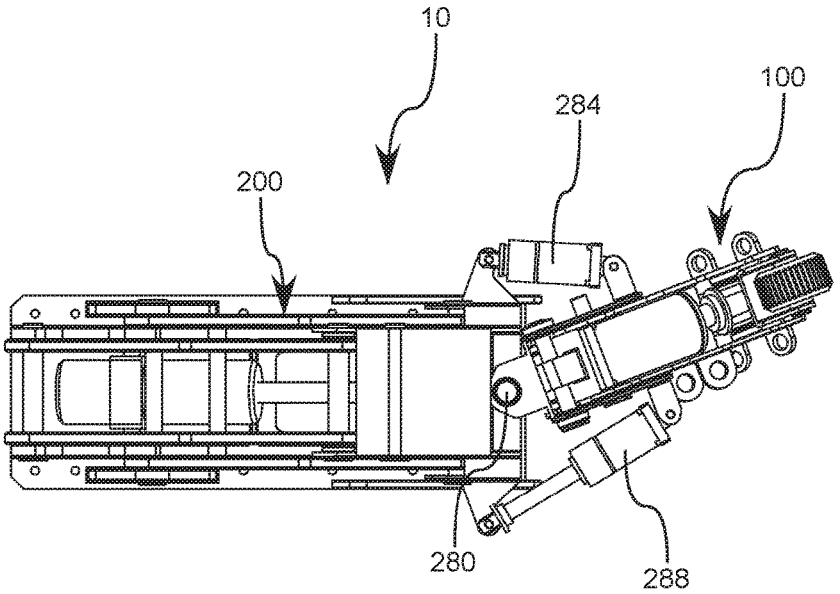

FIGS. 9-10 illustrate another of many relative degrees of motion which can be provided between the latching assembly 100 and extension assembly 200. As shown, FIGS. 9A-B illustrates a right rotated position and FIGS. 10A-B illustrate a left rotated position. In the embodiments shown, in order to allow for this relative rotated of the latching assembly 100, the latching assembly 100 can be attached to the extension assembly utilizing a rotational hinge 280 provided therebetween. Additionally, so as to dampen movement and oscillation, opposing dampers 284 and 288 can be provided to anterior sides of the latching assembly 100 and attach back to the dock or the extension assembly 200 as appropriate. In this manner the adjustable positive restraint docking system 10 can be biased back to a neutral position, while also absorbing energy from waves, wind, etc. by allowing motion or lateral swaying, within a certain degree, which would not result in contact between the dock, extension assembly, or latching assembly and the watercraft.

It will also be understood that any intermediate structures between the dock, extension assembly, and the latching assembly, as discussed herein, can be provided or attached directly to the dock. As such, the latching assembly 100 can be mounted directly to the dock 2 using any number of non-extending means utilizing rigid mounting plates, hinges, etc., wherein the latching assembly is positioned in a manner that would always allow for watercraft connection thereto.

Figure 11A:
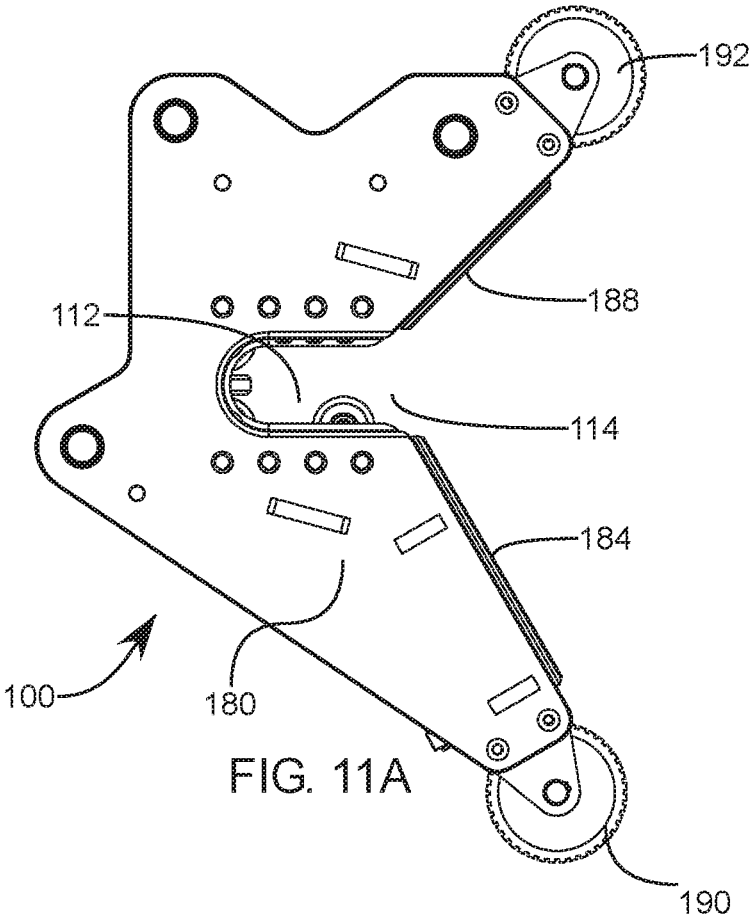
FIGS. 11A-B illustrate side and top views of a latching assembly for use in the adjustable positive restraint docking or mooring system of FIG. 1.
Figure 11B:
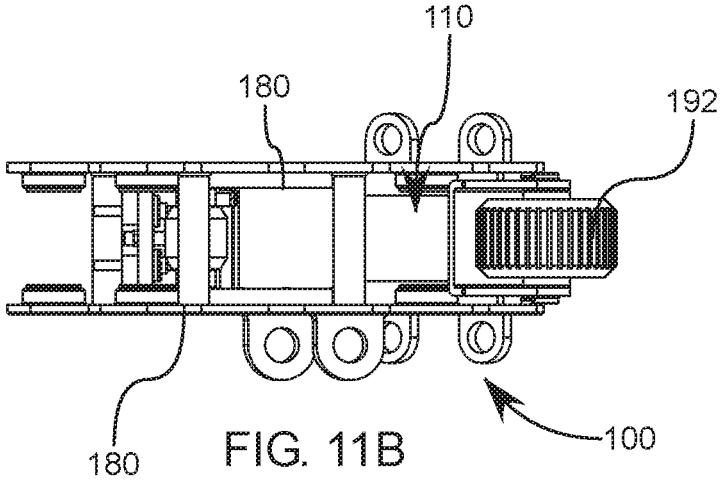
Figure 12:
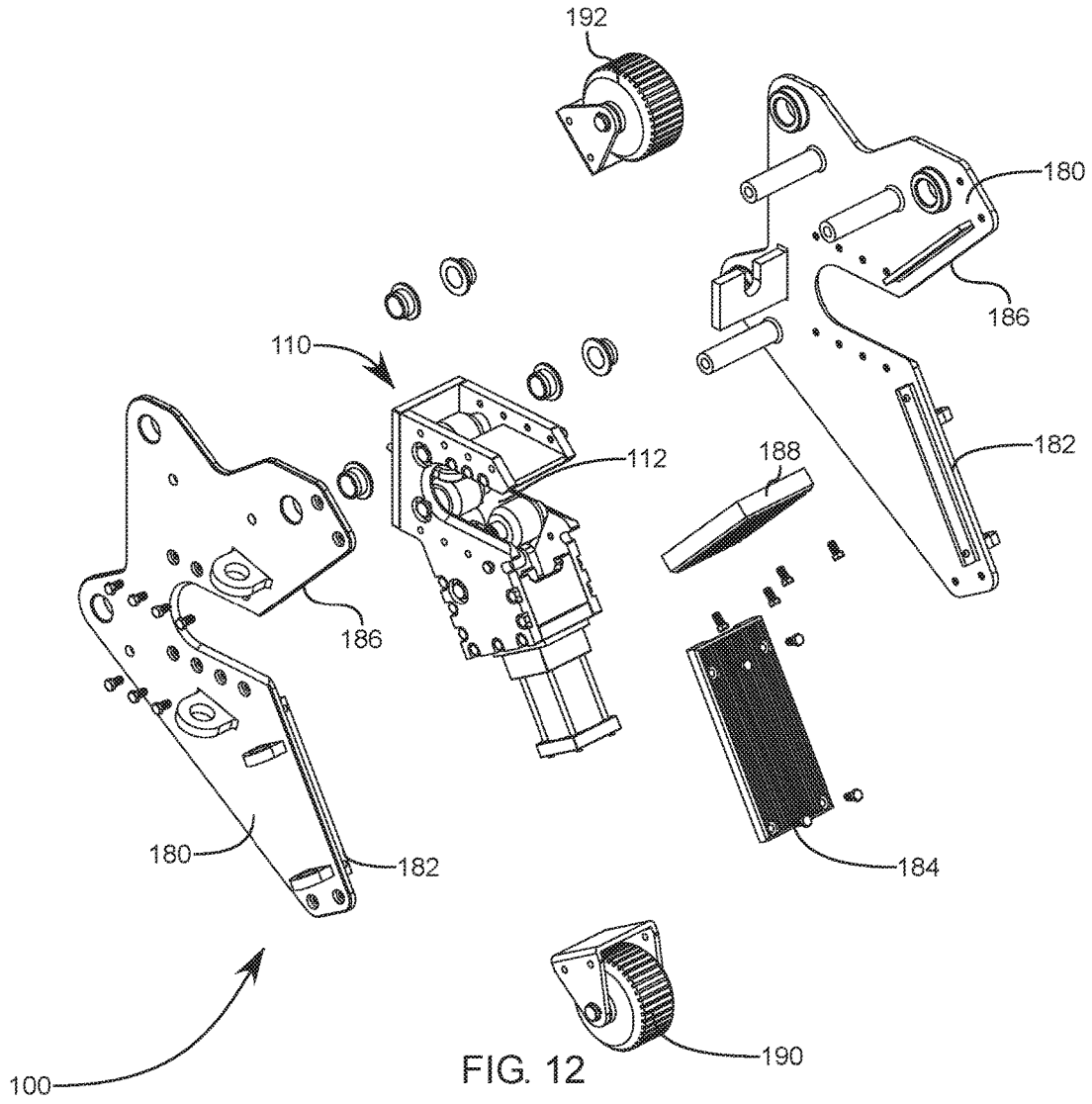
FIG. 12 illustrates an exploded perspective view of the latching assembly of FIGS. 11A-B.

FIGS. 11A-B illustrate side and top views of a latching assembly 100 while FIG. 12 illustrates an exploded view of the latching assembly 100. The latching assembly 100 as illustrated herein includes a latch head assembly 110 which is provided between opposing guide portions 180. The guide portions 180 are illustrated having opposing guide plates 180, each plate having opposing ramped portions 182 and 186 respectively. The latch head assembly 110 can then include a receiving channel for receiving the secondary locking component 30 therein at an open portion. In other words, the receiving channel 112 can be formed having a "U" shape corresponding in size and diameter or width with the secondary locking component 30 provided on the watercraft. Additionally, the guide plates 180 can have a corresponding cut-out matching the shape of the receiving channel 112 of the latch head assembly 110 so as to not block the receiving channel along its axis when attached thereto.

In the embodiments shown, the ramped portions 182 and 186 can also be provided with a low-friction sliding material, such as nylon, polypropylene, or some other thermoplastic material which can aide in reducing friction as a watercraft and associated secondary locking component approach, slide along the ramped portions, and ultimately engage with the receiving channel 112. In some embodiments, this low-friction sliding material can be replaceable or renewable and can protrude past the edges of the guide plates such that the sliding material can be configured to be a wearing component through contact and friction rather than the guide plates themselves.

Additionally, rollers 190 and 192 can be provided about end portions of the guide plates, a roller surface of the rollers can then be configured to extend partially into the angled portion beyond or at least within the same plane as the sliding material. In this manner, as the watercraft pitches or rocks while affixed to the adjustable positive restraint docking system 10 the rollers 190 or 192 and the sliding material 184 and 188 can take the impact and friction and thus act as wearable and replaceable components which can be intermittently serviced and ultimately replaced at necessary intervals.

Figure 13A:
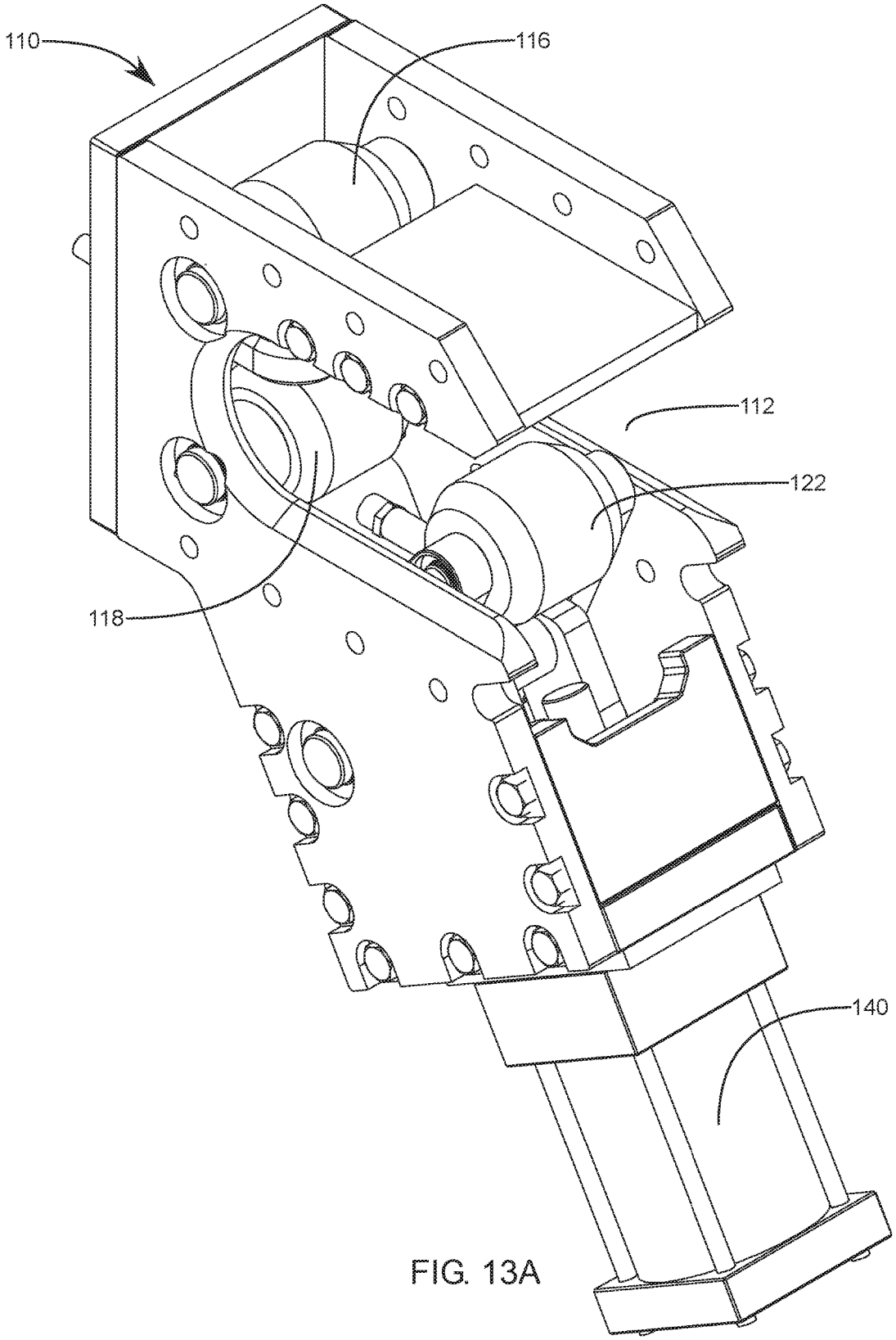
FIGS. 13A-C illustrate perspective, side, and front views of a latch head assembly for use in the latching assembly of FIGS. 11-12.
Figure 13C:
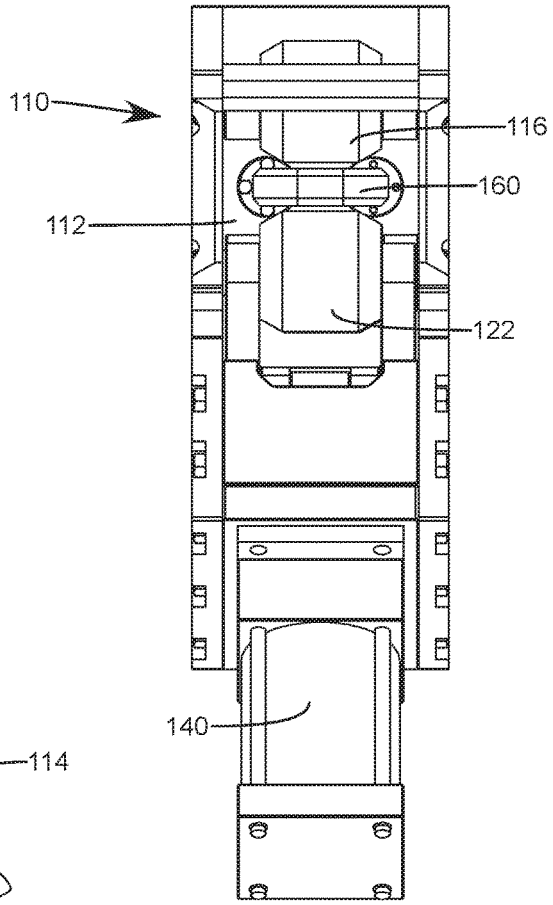
Figure 13B:
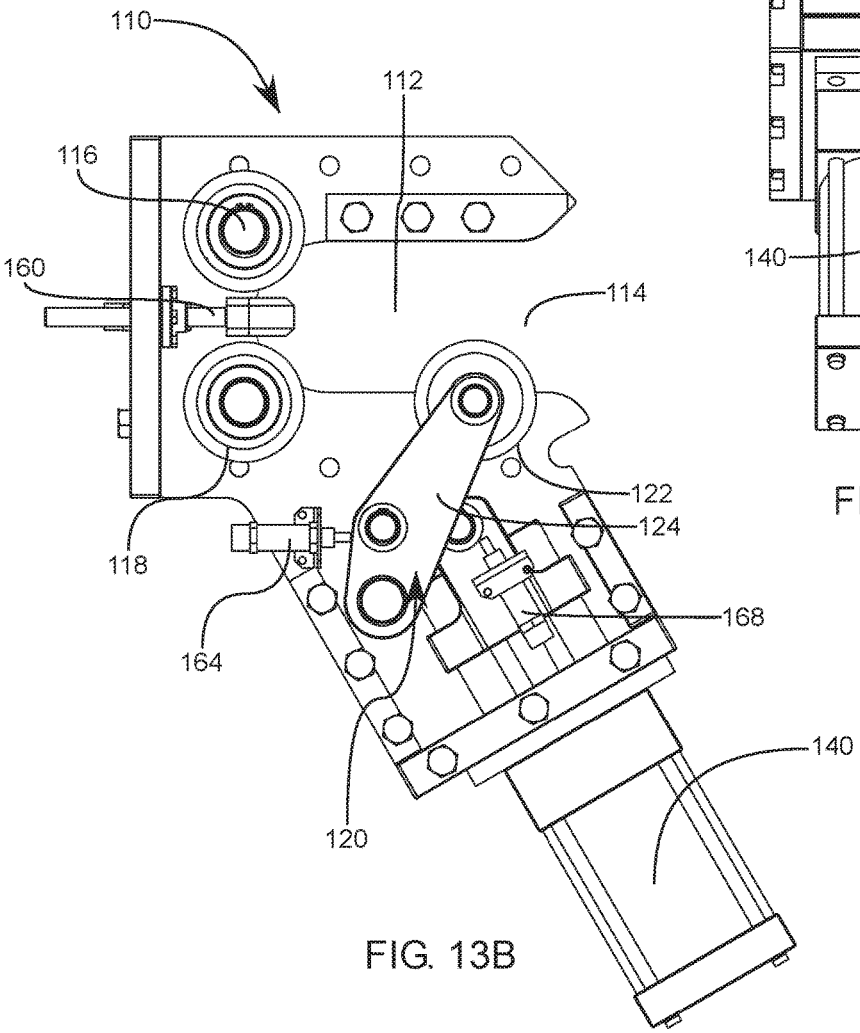
Figure 14A:
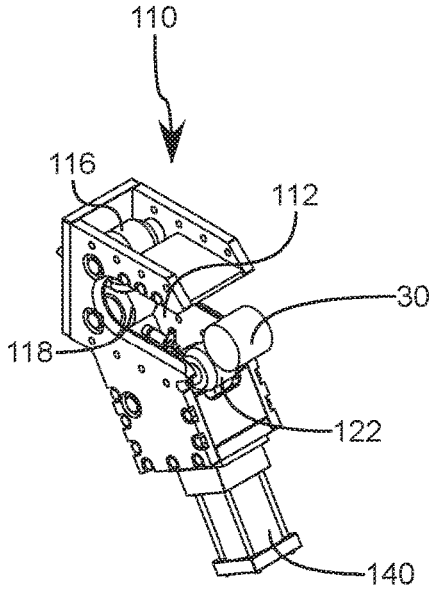
FIGS. 14A-D illustrate perspective, side, top, and side sectional views of the latch head assembly of FIGS. 13A-C in an open state during watercraft approach.
Figure 14B:
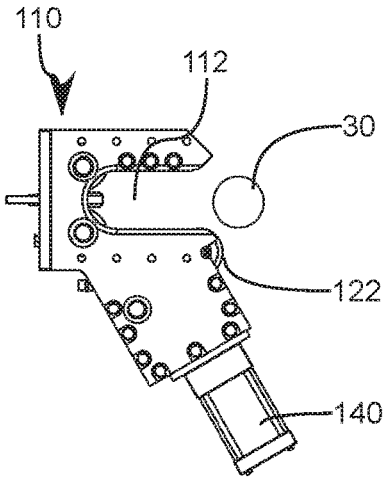
Figure 14C:
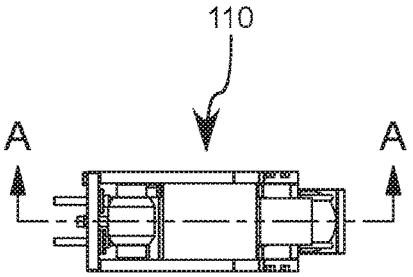
Figure 14D:
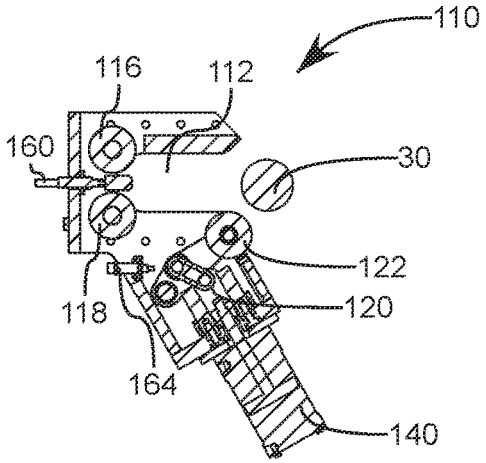
Figure 15A:
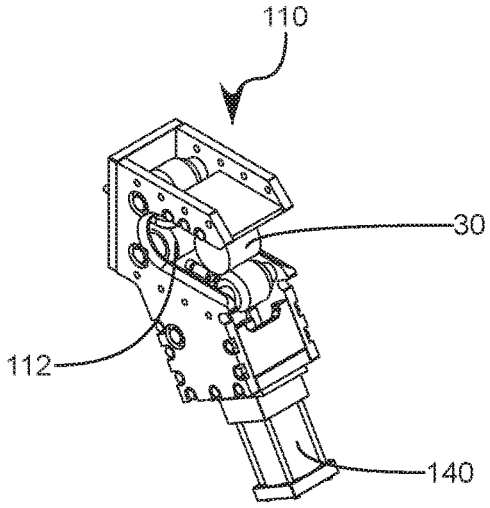
FIGS. 15A-D illustrate perspective, side, top, and side sectional views of the latch head assembly of FIGS. 13A-C in an intermediate state during watercraft approach.
Figure 15B:
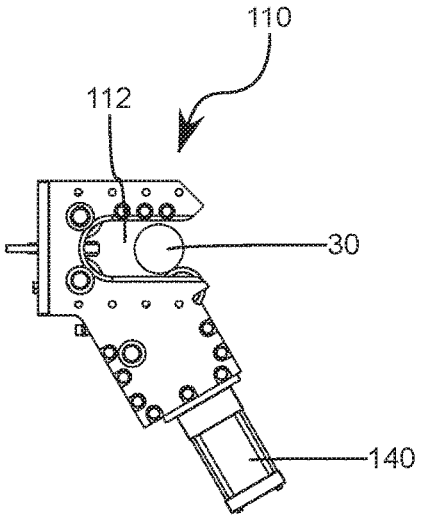
Figure 15C:
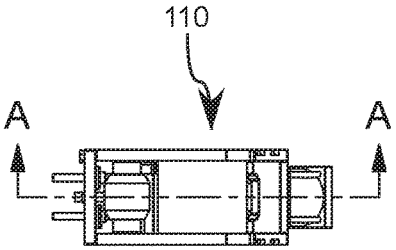
Figure 15D:
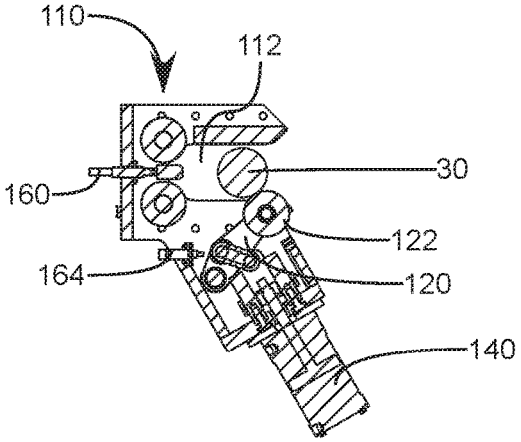

FIGS. 13A-C illustrate perspective, side cross-sectional, and front views of the latch head assembly 110. The latch head assembly includes the primary receiving channel which receives the secondary locking component and locks it within the channel. The channel can be selectively blocked through actuation of a linkage assembly 120 which can move a blocking arm 124 of the linkage to block the open portion of the channel behind the received secondary locking component after it has been received therein thus entering a locked state.

As illustrated, the blocking arm of the linkage can include a roller 122, which will then be located opposite the channel from receiving rollers 116 and 118. These rollers all act together to provide three contact points which will then allow the secondary locking component to rotate axially within the channel and allow pitching of the watercraft without wearing on the various components.

Figure 16A:
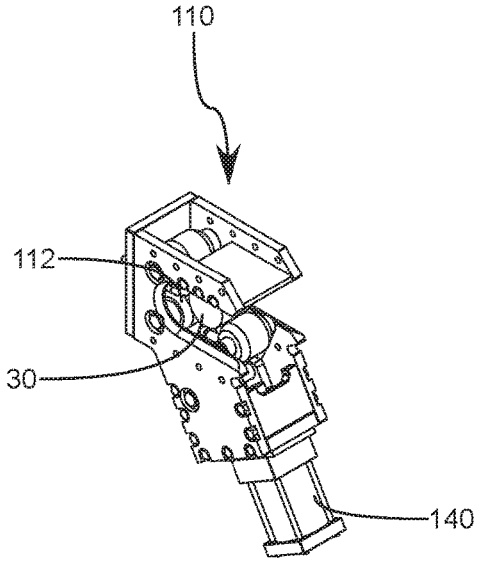
FIGS. 16A-D illustrate perspective, side, top, and side sectional views of the latch head assembly of FIGS. 13A-C in a partially locked/blocked state wherein the watercraft is secured.
Figure 16B:
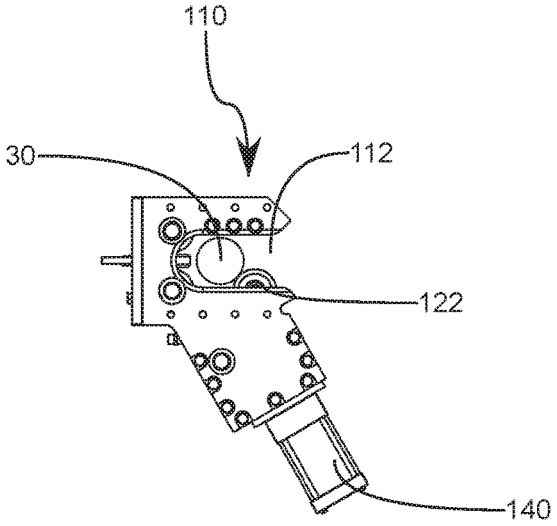
Figure 16C:
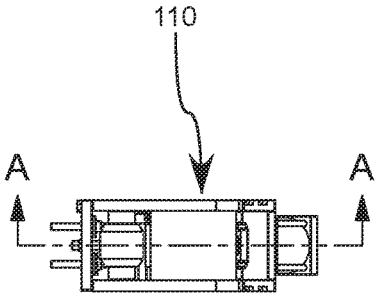
Figure 16D:
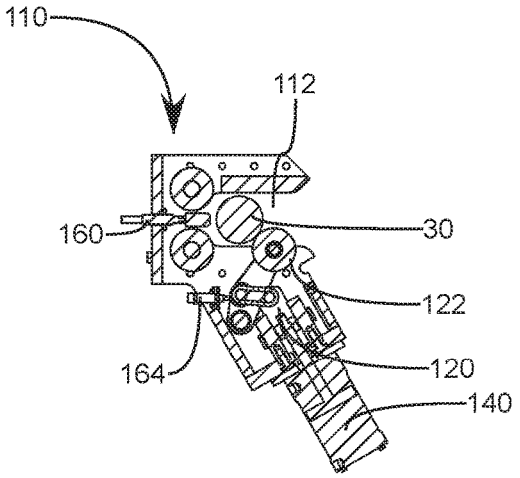
Figure 17A:
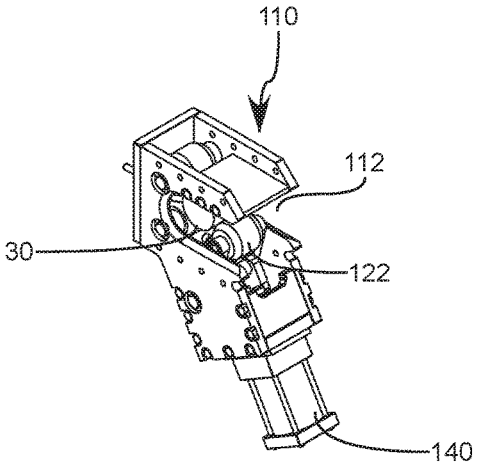
FIGS. 17A-D illustrate perspective, side, top, and side sectional views of the latch head assembly of FIGS. 13A-C in a fully locked/blocked state wherein the watercraft is secured.
Figure 17B:
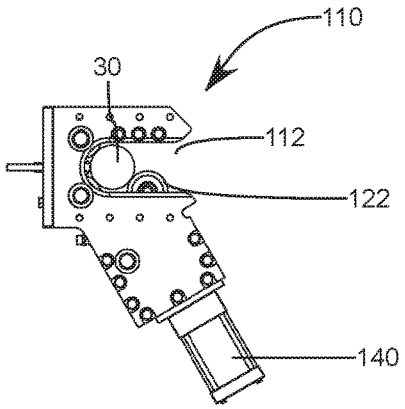
Figure 17C:
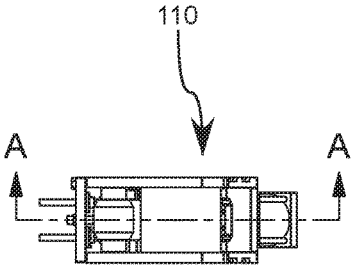
Figure 17D:
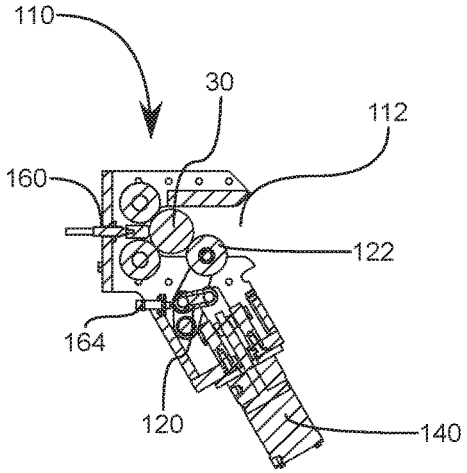

The linkage assembly 120 can be actuated by an actuation mechanism 140, herein illustrated as a hydraulic cylinder. Upon actuation of the actuation mechanism, the linkage can be pushed through a toggle point as the blocking arm 124 extends partially across the open portion of the receiving channel. The toggle point of the linkage can then act as a positive lock having high mechanical advantage over any pulling forces applied to the secondary locking component being transferred to the linkage. While one having ordinary skill in the art of linkage design will appreciate the various mechanics involved with creating toggle points, FIG. 16D particularly illustrates the linkage at the toggle point through which the linkage passes when moving between an open and an unblocked state.

FIGS. 14-17 illustrate various perspective, side, top, and side cross-sectional views of the latching head assembly 110 receiving a secondary locking component 30 through various engagement states. FIGS. 14A-D illustrate an unengaged state during approach of the secondary locking component. FIGS. 15A-D illustrate a partially engaged state as the actuation mechanism 140 is just beginning to actuate the linkage 120. FIGS. 16A-D illustrate a partially engaged state as the linkage assembly passes through the toggle point. Finally, FIGS. 17A-D illustrate a fully blocked and locked state.

The latch head assembly can also include one or more status sensors 160, 164, and 168. The sensor 160 can be referred to a presence sensor, and can be provided as a pressure sensor, mechanical trip switch, or proximity sensor, or some other switch, that when compressed, can indicate the presence of a secondary locking component within the receiving channel. Meanwhile, sensor 164 can instead be positioned so as to provide an indication of when the linkage assembly is positioned in the fully blocked state. This sensor can also be a pressure sensor or switch which compresses as the linkage moves into the desired blocked state. Further, sensor 168, which is best illustrated in FIG. 13B, can be positioned so as to provide indication of when the linkage assembly is in a fully open state. This sensor can also be provided as a pressure sensor or switch and be provided in a position which would cause the sensors compression when the linkage assembly 120 is in the fully open state.

As such, sensor 168 is active or depressed in FIGS. 14-15 thus indicating that the linkage assembly 120 is in an unblocked or open state. Meanwhile, no sensors are active in FIGS. 15A-D thus indicating that the linkage assembly 120 is in an intermediate point between the unblocked state and blocked state. In FIGS. 16A-D the sensor 164 is indicating that the linkage is now in a toggled and blocked/locked state, and finally in FIGS. 17A-D both the presence sensor 160 and the sensor 154 are indicating that the latch head assembly is in a toggled locked state with a secondary locking component 30 present therein in a fully engaged state.

Also, as illustrated herein, the secondary locking component 30 is provided as a horizontally oriented bar. This horizontally oriented bar provides a wide range of relative points at which it can be secured within the receiving channel of the adjustable positive restraint docking system 10. The relative length of this bar allows for a certain degree of translation axially along the bar within the receiving channel and can thus account for a range of positioning of the watercraft along the width or edge of the dock or within a slip. However, in some instances too much axial translation in this manner could also result in the watercraft coming into contact and potentially damaging itself with surrounding watercraft or structures. As such the secondary locking component 30 can be provided with supports or stops 34 which limit this lateral or axial translation.

Figure 18A:
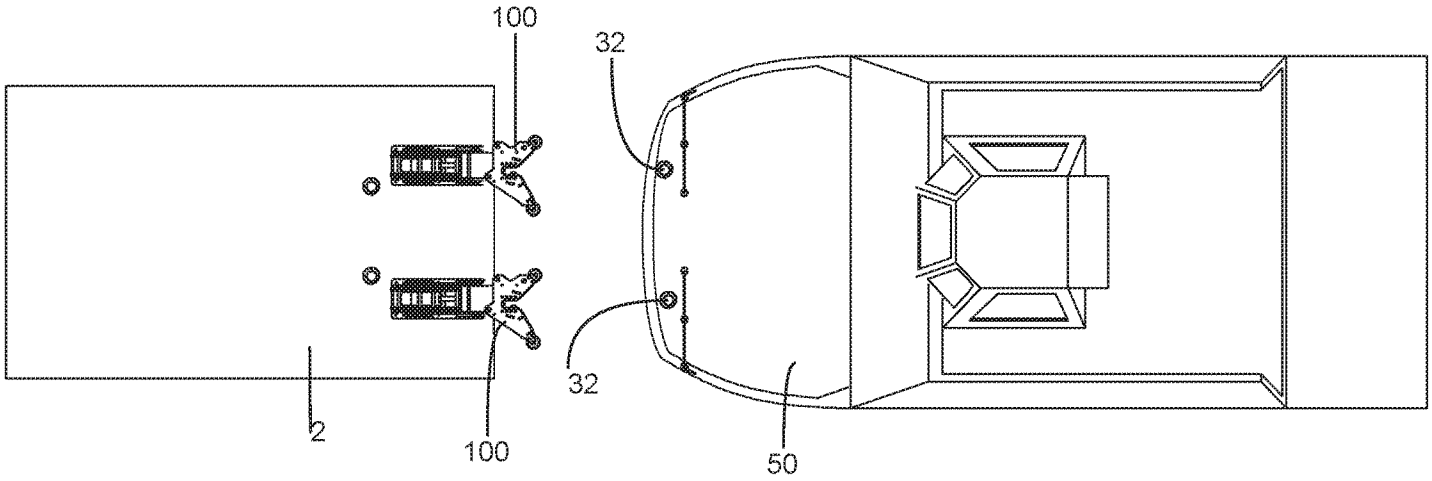
FIG. 18A illustrates a top view of an alternative orientation of a latching assembly and an alternative secondary locking component being provided on the watercraft.
Figure 18B:
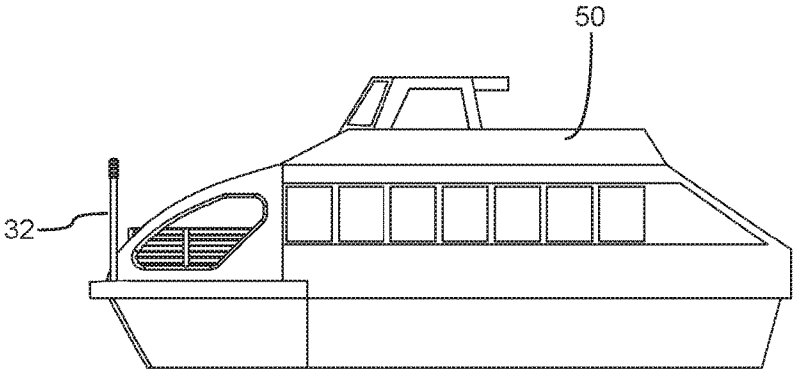
FIG. 18B illustrates a side view of a watercraft having the secondary locking component of FIG. 18A provided thereon.

It will also be understood that the latch head assembly shown in the in the previously discussed embodiments was shown being configured to receive a horizontally-oriented secondary locking component. However, in some alternative embodiments of the present invention, and as illustrated in FIGS. 18A-B, it is also possible to rotate the latching assembly 100 such that the receiving channel is oriented to receive a vertically oriented secondary locking component 32, such as a vertical pole. This could be achieved by merely rotating the latching assembly 90-degrees with respect to the extension assembly or dock as illustrated in FIGS. 18A-B.

Also illustrated herein the rollers 192 and 190 are provided in a rigid configuration at opposing sides of the guide plates 180. In yet additional embodiments the rollers could be provided in a spring-loaded configuration where the rollers themselves are provided on resilient springs. In yet additional embodiments the upper and lower guide arms of the guide plates could be provided as hinged extensions which are also allowed to pivot, wherein the upper and lower guide arms can be spring-loaded themselves.

In yet additional embodiments a plurality of horizontally oriented latch assemblies can be provided in a stacked configuration, or in perpendicular orientations wherein the latch assemblies can be simultaneously attached to a plurality of correspondingly oriented secondary locking components. In this manner, a more accurate and secure docking position can be ensured through a plurality of engagement points and orientations.

It will then be understood that the latching assembly can be oriented at any angle relative to gravity with a corresponding angled secondary locking component, so as to suit any particular vessel's needs or environmental factors.

Additionally, the watercraft can include additional sensors about the secondary locking component which can include proximity sensors, which can be either passive or active, such as near field communication or RFID, which can indicate proximity to the latching components.

In some additional embodiments the various sensors can provide signals regarding the locked state, presence of the secondary locking component, etc. These signals can then be transmitted to a controller so as to indicate which portions of the watercraft are properly docked. In some such instances the controller can then provide feedback to the captain, or in the case of unmanned or automatic docking functions, so as to indicate which direction the watercraft must be pivoted in order to properly engage to additional latching assemblies.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention.

I claim:

1. An adjustable positive restraint docking system, the system comprising:

a latching assembly, the latching assembly being configured to affix to a docking point on a dock, the latching assembly further comprising:

a latching head assembly, the latching head assembly further comprising:

a receiving channel having an open portion being configured to receive a secondary locking component provided about a watercraft;

a linkage assembly configured to selectively block or open the open portion of the receiving channel, the linkage assembly being configured to pass through a toggle point between an open state and a locked state; and one or more rollers provided within the receiving channel, the one or more rollers being configured to allow an axial rotation of the secondary locking component within the channel in the locked configuration;

one or more dampers provided about one or more anterior sides of the latching head assembly, at least one of the one or more dampers being configured to allow pivoting of the latching head in a horizontal plane; and one or more guide portions being configured to guide an approaching secondary locking component into alignment with the receiving channel from a plurality of approach angles.

2. The adjustable positive restraint docking system of claim 1, the system further comprising:

an extension assembly provided between the latch assembly and the dock, the extension assembly being configured to provide the latch assembly in an extended state or a stowed state.

3. The adjustable positive restraint docking system of claim 2, wherein the extension assembly is provided having a 4-bar linkage.

4. The adjustable positive restraint docking system of claim 1, wherein the latch assembly further comprises:

a plurality of rollers provided in a rear portion of the receiving channel.

5. The adjustable positive restraint docking system of claim 4, wherein the linkage assembly further comprises a roller, wherein the roller is displaced by the linkage so as to block the open portion of the receiving channel in the locked state.

6. The adjustable positive restraint docking system of claim 1, wherein the linkage assembly further comprises a roller, wherein the roller is displaced by the linkage so as to block the open portion of the receiving channel in the locked state.

7. The adjustable positive restraint docking system of claim 1, wherein the secondary locking component is provided as a bar extending from the watercraft so as to extend into the receiving channel of the latch head assembly.

8. The adjustable positive restraint docking system of claim 1, further comprising a presence sensor located within the receiving channel of the latch head assembly, the presence sensor being configured to detect the presence of a secondary locking component within the receiving channel.

9. The adjustable positive restraint docking system of claim 1, further comprising a first linkage sensor located about the linkage assembly, the first linkage sensor being configured to detect when the linkage assembly is in the locked state.

10. The adjustable positive restraint docking system of claim 9, further comprising a second linkage sensor located about the linkage assembly, the second linkage sensor being configured to detect when the linkage assembly is in the open state.

11. The adjustable positive restraint docking system of claim 1, wherein the receiving channel is configured to receive a horizontally oriented secondary locking component.

12. The adjustable positive restraint docking system of claim 1, wherein the receiving channel is configured to receive a vertically oriented secondary locking component.

13. The adjustable positive restraint docking system of claim 1, wherein the one or more dampers are a plurality of dampers being provided about opposing anterior sides of the latching head assembly.

14. The adjustable positive restraint docking system of claim 1, further comprising a vertical damper, the vertical damper being connected to the latching head along a vertical axis, the vertical damper being configured to allow the latching head assembly to translate vertically.

15. The adjustable positive restraint docking system of claim 13, further comprising a vertical damper, the vertical damper being connected to the latching head along a vertical axis, the vertical damper being configured to allow the latching head assembly to translate vertically.

16. The adjustable positive restraint docking system of claim 1, wherein the guide portions are provided as opposing plates having opposing ramped portions, the ramped portions being configured to guide the secondary locking component toward a central portion containing the receiving channel, the opposing ramp portions extending outwardly from the open portion of the guide channel, the opposing ramps also being angled with respect to one another having a vertex about the receiving channel.

17. An adjustable positive restraint docking system, the system comprising:

a latching assembly, the latching assembly being configured to affix to a watercraft, the latching assembly further comprising:

a latching head assembly, the latching head assembly further comprising:

a receiving channel having an open portion being configured to receive a secondary locking component provided about a docking point on a dock;

a linkage assembly configured to selectively block or open the open portion of the receiving channel, the linkage assembly being configured to pass through a toggle point between an open state and a locked state, wherein the linkage assembly includes a roller, wherein the roller is displaced by the linkage so as to block the open portion of the receiving channel in the locked state; and one or more rollers provided within the receiving channel, the one or more rollers being configured to allow an axial rotation of the secondary locking component within the channel in the locked configuration;

a presence sensor located within the receiving channel of the latch head assembly, the presence sensor being configured to detect the presence of a secondary locking component within the receiving channel;

a first linkage sensor located about the linkage assembly, the first linkage sensor being configured to detect when the linkage assembly is in the locked state; and a second linkage sensor located about the linkage assembly, the second linkage sensor being configured to detect when the linkage assembly is in the open state;

one or more dampers provided about one or more anterior sides of the latching head assembly, at least one of the one or more dampers being configured to allow pivoting of the latching head in a horizontal plane;

one or more guide portions being configured to guide an approaching secondary locking component into alignment with the receiving channel from a plurality of approach angles;

a plurality of rollers provided in a rear portion of the receiving channel; and wherein the secondary locking component is provided as a bar extending from the dock, the bar being configured to extend into the receiving channel of the latch head assembly.

18. The adjustable positive restraint docking system of claim 17, wherein the receiving channel is configured to receive a horizontally oriented secondary locking component.

19. The adjustable positive restraint docking system of claim 17, wherein the receiving channel is configured to receive a vertically oriented secondary locking component.

20. An adjustable positive restraint docking system, the system comprising:

a latching assembly, the latching assembly being configured to affix to a docking point on a dock, the latching assembly further comprising:

a latching head assembly, the latching head assembly further comprising:

a receiving channel having an open portion being configured to receive a secondary locking component provided about a watercraft;

a linkage assembly configured to selectively block or open the open portion of the receiving channel, the linkage assembly being configured to pass through a toggle point between an open state and a locked state, wherein the linkage assembly includes a roller, wherein the roller is displaced by the linkage so as to block the open portion of the receiving channel in the locked state; and one or more rollers provided within the receiving channel, the one or more rollers being configured to allow an axial rotation of the secondary locking component within the channel in the locked configuration;

a presence sensor located within the receiving channel of the latch head assembly, the presence sensor being configured to detect the presence of a secondary locking component within the receiving channel;

a first linkage sensor located about the linkage assembly, the first linkage sensor being configured to detect when the linkage assembly is in the locked state; and a second linkage sensor located about the linkage assembly, the second linkage sensor being configured to detect when the linkage assembly is in the open state;

one or more dampers provided about one or more anterior sides of the latching head assembly, at least one of the one or more dampers being configured to allow pivoting of the latching head in a horizontal plane;

one or more guide portions being configured to guide an approaching secondary locking component into alignment with the receiving channel from a plurality of approach angles;

a plurality of rollers provided in a rear portion of the receiving channel; and wherein the secondary locking component is provided as a bar extending from the watercraft, the bar being configured to extend into the receiving channel of the latch head assembly.

* * * * *